United States Patent [19]

Yin

[11] 4,342,601

[45] Aug. 3, 1982

[54] USE OF HETEROPOLYSACCHARIDE S-119 AS A PAPER FINISH

[75] Inventor: Robert I. Yin, La Jolla, Calif.

[73] Assignee: Merck & Co., Inc., Rahway, N.J.

[21] Appl. No.: 168,238

[22] Filed: Jul. 10, 1980

[51] Int. Cl.[3] ..... C08L 5/00; C12P 19/04

[52] U.S. Cl. ..... 106/209; 106/205

[58] Field of Search ..... 106/209, 205; 536/1; 162/175

[56] References Cited

U.S. PATENT DOCUMENTS

| | | | |
|---|---|---|---|
| 3,969,536 | 7/1976 | Ikeda | 426/565 |
| 4,211,774 | 7/1980 | Kang et al. | 536/1 |
| 4,259,451 | 3/1981 | Steenbergen | 435/253 |
| 4,269,939 | 5/1981 | Kang | 435/104 |

FOREIGN PATENT DOCUMENTS 1467127 3/1977 United Kingdom .

OTHER PUBLICATIONS

Chem. Abst. 89:199,394x.

Hisamatsu et al., Carbohydrates Research, 61 (1978) pp. 89–96.

Zevenuizen, Carbohydrate Research, 26 (1973) pp. 409–419.

*Primary Examiner*—Theodore Morris

*Attorney, Agent, or Firm*—Gabriel Lopez; Hesna J. Pfeiffer

[57] ABSTRACT

S-119 is used as a finish for paper either alone, i.e., as a sizing, or as a water retention aid and to improve ink, solvent, oil, grease, and wax holdout in pigmented coatings.

6 Claims, No Drawings

USE OF HETEROPOLYSACCHARIDE S-119 AS A PAPER FINISH

BACKGROUND OF THE INVENTION

Many polysaccharides have been used in the paper industry. Because of their unique properties and the very different functionalities required for different applications, the individual polysaccharides have distinct and very specific uses. For example, gum arabic is used as a mucilage; guar gum is known as a wet-end additive; karaya gum is a binder for preparation of long-fibered, lightweight paper; locust beam gum is a known beater aid; algin is useful both as a sizing agent, and in pigmented coatings.

SUMMARY OF THE INVENTION

It has now been found that heteropolysaccharide S-119 and similar heteropolysaccharides such as those produced from *A. tumefaciens* A-8 and A-10 and from other *A. radiobacter* strains are useful in finishing paper, i.e., as a paper size or as a component of a pigmented paper coating.

DETAILED DESCRIPTION OF THE INVENTION

Paper sizes comprise primarily water and some agent. Size is used to fill the surface paper pores and to retard penetration of ink and water. Aqueous compositions of 0.001 to 10% S-119 (wt/wt) in solution, preferably 0.5 to 2%, have been found to function as paper sizes. A paper size using S-119 is prepared by mixing water and S-119 at ambient temperature with agitation for about one hour or until the viscosity stabilizes.

Pigmented paper coatings are used to finish paper when, for example, greater ink and water retardation is desired, or a specific surface is needed (dull coated or gloss coated). A pigmented paper coating is generally an aqueous composition of pigment and the following components:

| | Parts/100 Parts Pigment | |
|---|---|---|
| | Broad | Preferred |
| Binding agent* | 5–50 | 10–25 |
| Water retention agent | 0.1–10 | 0.1–2 |
| Optionally: | | |
| Brightening agent | 0–3 | 0.1–1.0 |
| Dispersing agent | 0–1 | 0.1–0.4 |
| Alkali (soda lye, ammonia, etc.) | 0–1 | 0.05–0.5 |

*Preferably as a 20–50% aqueous dispersion.

The agents used for each function can be either a single compound or a combination of compounds.

Pigments generally used in such formulations are: kaolins, calcium carbonate, satin white, $TiO_2$, and precipitated barium sulfate. The pigments are typically white but colored pigments are also used. A synthetic binder such as latex is typical; however, natural binders such as starch, protein, and casein are also known. Water retention agents include CMC, polyvinyl alcohol, sodium alginate, and the carboxymethyl ether of the flour of locust bean gum and guar gum, and also tamarind seed polysaccharide.

In pigmented coatings, S-119 is used at 0.1 to 10 parts per 100 parts of pigment; preferably 0.1 to 2.0 parts per 100. At these usage levels, S-119 also functions to improve ink, solvent, oil, grease, and wax holdout, functions for which sodium alginate and CMC are typically used.

The following is a typical pigmented coating formulation:

| Components | Amount (parts dry by weight) |
|---|---|
| Water | 43.00 |
| CALGON ®, tetrasodium pyrophosphate | 0.20 |
| DISPEX ® N40, organic dispersant | 0.20 |
| Clay, No. 1 coating grade | 100.00 |
| S-119 | 0.60 |
| DOW LATEX ® 620, styrene butadiene | 15.00 |

®CALGON is a registered trademark of MERCK & CO., Inc.
DISPEX is a registered trademark of Allied Colloids, Inc.
DOW LATEX is a registered trademark of Dow Chemical Co.

The ingredients are mixed in the order shown. A sequestering agent is added depending on the hardness of the water used. Water is added to adjust the final concentration to 40–65% solids. The coating is applied by any conventional method such as blade, air knife, roll, or rod coating.

In paper finishes, S-119 exhibits excellent properties as a thickening film-forming, ink holdout, and water-retention agent. S-119 can be used either alone or in combination with other known thickening, film-forming, ink holdout, and water-retention agents. Combination with alginates is recommended. The rheology of S-119 permits it to be pumped at very high concentrations (solids of about 50% wt/wt), therefore permitting preparation of high concentration slurries.

DESCRIPTION OF S-119 AND SIMILAR POLYSACCHARIDES

Organisms classified as *Agrobacterium radiobacter* IFO (Institute of Fermentation, Osaka) 12607, IFO 12664, IFO 12655, IFO 13127, IFO 13256, IFO 13532 and IFO 13533 have been used to produce exocellular polysaccharides (Hisamatsu, et al., "Acidic Polysaccharides Containing Succinic Acid in Various Strains of *Agrobacterium*", Carbohydrate Research, 61 (1978) 89–96). These organisms were grown in a synthetic medium described in Amemura, et al., Hakko Kogaku Zasshi; 49 (1971) 559–564, Chem. Abst. 75, 1971, 74882j.

An exopolysaccharide containing D-glucose, D-galactose, pyruvic acid, and O-acetyl groups in the approximate proportions 6:1:1:1.5 is described by L. P. T. M. Zevenhuizen, "Methylation Analysis of Acidic Exopolysaccharides of Rhizobium and Agrobacterium", Carbohydrate Research, 26 (1973) 409–419. The organisms used by Zevenhuizen are described as *A. tumefaciens* A-8 and A-10.

A variant strain of *A. radiobacter*, ATCC 31643, produces a water-soluble heteropolysaccharide of composition similar to that described for *A. tumefaciens* A-8 and A-10 when incubated in a selected nutrient medium. An unrestricted deposit of this hitherto undescribed organism was made with the American Type Culture Collection on May 12, 1980 under Accession No. ATCC 31643.

The organism was isolated from a soil sample obtained in Kahuka, Hawaii. The organism was picked as a gummy colony after five days' incubation at 30° C. from an E-1 agar plate with 1% 42DE corn syrup as the carbon source. The isolate was then pure cultured on nutrient agar.

A YM flask seed was started with a fresh NA plate and placed on a gyrotary shaker at 30° C. Approximately 24 hrs. later this seed was used to inoculate an E-1 flask with 3% hydrolyzed starch as the carbon source. This flask was also placed on a shaker at 30° C. Approximately 72 hrs. later the flask was noted to have viscous beer and upon addition of two volumes of 99% IPA a fibrous precipitate was observed.

Another YM seed flask was prepared in the above fashion and used at 24 hrs. to inoculate four flasks containing various media. These flasks were incubated on a shaker at 30° C. for about 72 hrs. at which the pH, viscosity, gum yield, and product viscosity were measured. The results are shown in Table 1.

TABLE 1

EFFECT OF MEDIA ON GUM PRODUCTION

| Medium | pH | Beer Vis.(cp) | Gum Yield(%) | 1% Product Vis.(cP) |
|---|---|---|---|---|
| E-1 | 7.4 | 120 | 0.650 | ND |
| E-1 − $NH_4NO_3$ + 0.19% $KNO_3$ | 8.2 | 160 | 0.310 | ND |
| E-1 + 0.15% Promosoy | 7.2 | 1000 | 1.273 | ND |
| E-1 + HoLe salts | 6.9 | 1800 | 1.524 | 800 |

ND: Not determined

E-1 medium contains 5 gms of dipotassium phosphate, 0.1 gm of magnesium sulfate, 0.9 gm of ammonium nitrate, 0.5 gm of Promosoy 100 (an enzymatic digest of soybean meal sold by Central Soya Chemurgy Division), 30 gms of dextrose and 1 liter of tap water. The pH of the E-1 medium is about 7.6 to 7.8.

The organism has been scaled-up in 14L and 70L fermentors. The data on these scale-ups is given in Table 2. Viscosities are measured on a Brookfield LVF viscometer at 60 rpm, room temperature, with spindles 2 (<500 cP), 3 (500–2000 cP), or 4 (>2000 cP).

TABLE 2

| Medium | Age (hrs) | Beer Vis.(cP) | RCS (%)* | Gum Yield (%) | 1% Product Vis.(cP) |
|---|---|---|---|---|---|
| E-1 + HoLe salts | 0 | — | 3.07 | — | — |
| + 1 ppm Fe++ | 63 | 1430 | 0.1 | 2.03 | 450 |
| Same as above | 0 | — | 2.55 | — | — |
| | 42 | 1330 | 0.1 | 1.60 | 370 |
| Same as above | 0 | — | 3.05 | — | — |
| | 38 | 1270 | 0.1 | 1.84 | 355 |
| Same as above + | 0 | — | ND | — | — |
| 0.03% Promosoy 100 | 38 | 1490 | 0.86 | 1.86 | — |
| + 0.01% $MgSO_4$. $7H_2O$ + 0.06% $NH_4NO_3$. Total of 5% glucose added as carbon source | 77 | 2350 | 0.1 | 2.41 | 440 |

*Residual carbon source; fermentation is "complete" when RCS ≦ 0.1%.

The following is a summary of the taxonomic study of ATCC 31643, hereinafter also referred to as S-119.

A. Characteristics of Colonial Morphology

On nutrient agar, small translucent non-pigmented colonies (0.2–0.3 mm in diameter) appear in 2 days at ambient temperature; diameter reaches 1.2–1.5 mm after 5 days' incubation. The colonies are round, entire, and convex. Slimy properties are not observed.

On YM agar, small opaque, mucoid, white-to-gray colonies (0.2–0.3 mm in diameter) appear in 2 days at ambient temperature; diameter reaches 2.2–2.5 mm after 5 days' incubation. The colonies are round, entire, and convex, but a thick wrinkled formation appears after prolonged incubation. No hard membraneous texture is observed, although it is slimy.

B. Characteristics of Cell Morphology

The strain S-119 is a gram-negative, rod-shaped bacterium. On nutrient agar the average size of the cell is 0.5 by 0.8–1.2 μm, round at both ends. Vacuole-like structures are often observed. Bipolar stain may be common.

On YM agar the cells are larger; average size is about 0.6 by 2.0–2.5 μm, round at both ends. One end is larger than the other. Vacuoles often appear and this causes uneven staining of the cell. Some cells tend to have a curvature, and pallisade arrangement of cells is common. Y-shaped cells are occasionally observed. Motility is by means of the mixed flagellation, polar monotrichously, and peritrichously flagellation.

C. Physiological and Biochemical Characteristics

Cytochrome oxidase, catalase positive; aerobic. Organism is capable of growth at 41° C. but not at 43° C. Survival at 60° C. for 30 minutes. Tolerance to 3.0% but not to 6.5% NaCl. Growth at pH's between 5 and 12.

Many carbohydrates were utilized. Acid but not gas was produced from the following carbohydrates.

D-Xylose
L-Arabinose
D-Glucose
Fructose
Galactose
Mannose
Lactose
Maltose
Melibiose
Sucrose
Trehalose
Raffinose
Adonitol
Sorbitol
Inositol Acid was *not* produced from the following carbohydrates.

L-Rhamnose
Dulcitol
Salicin
Inulin

Neutral or weak alkali reaction observed. No serum zone formed. $H_2S$ produced from cystein. ADH, LDC and ODC were negative. Indole, VP, MR, and Simmon's citrate tests were negative. Gelatin, casein, starch, Tween 80, esculin, and egg yolk were not hydrolyzed. The 3-Ketolactose test was negative.

Organisms grown on EMB, MacConkey, and SS agar but not on Mannitol salt or Tellurite Blood agar. Congo Red dye was absorbed. Tolerance to 0.02 and 0.1% tiphenyltetrazolium chloride.

D. Antibiotic Susceptibility Test

The strain S-119 is susceptible to the following antibiotics.

| | | | |
|---|---|---|---|
| Kanamycin | 30 μg | Erythromycin | 15 μg |
| Neomycin | 30 μg | Tetracycline | 30 μg |
| Chlortetracycline | 5 μg | Gentamicin | 10 μg |
| Novobiocin | 30 μg | Carbenicillin | 50 μg |

The strain S-119 is *not* susceptible to the following antibiotics.

| | | | |
|---|---|---|---|
| Penicillin | 10 units | Colistin | 10 μg |
| Streptomycin | 10 μg | Polymyxin B | 300 units |

E. Nutritional Characteristics

Growth factors are not required for growth. Ammonium salts serve as sole nitrogen source. At least 53 out of the 114 organic compounds tested are utilized as a sole source of carbon and energy. They are as follows:

D-Ribose
D-Xylose
D-Arabinose
L-Arabinose
D-Fucose
L-Rhamnose
D-Glucose
D-Mannose
D-Galactose
D-Fructose
Sucrose
Trehalose
Maltose
Cellobiose
Lactose
Gluconate
2-Ketogluconate
Salicin
Acetate
Propionate
Succinate
Fumarate
D-Malate
DL-Lactate
DL-Glycerate
Citrate
Pyruvate
Mannitol
Sorbol
Adonitol
Glycerol
Ethanol
N-Propanol
p-Hydroxybenzoate
Quinate
Glycine
L-α-Alanine
D-α-Alanine
β-Alanine
L-Serine
L-Threonine
L-Leucine
DL-Norleucine
L-Aspartate
L-Glutarate
DL-Arginine
DL-Ornithine
α-Aminobutyrate
L-Histidine
L-Proline
L-Tyrosine
Betaine
Sarcosine F. Biochemical and Other Miscellaneous Tests See Table 3.

G. Identification

The strain S-119 is a gram-negative, aerobic, rod-shaped organism. Motile by mixed (i.e., polar and peritrichous) flagella. Oxidase and catalase are positive. Many carbohydrates are utilized. Cells are often pear-shaped; vacuolated forms are pallisade arrangement of cells are common. Y-shaped forms and accumulation of poly-β-hydroxybutyrate may be observed. Citrate is utilized. According to the Bergey's Manual (8th edition) the organism is a member of the genus *Agrobacterium*. The similarity value ($S_J$) of the organism compared with a reference strain *Agrobacterium radiobacter* (ATCC 19358) showed 76.9%, which is within the species level according to Colwell and Liston (1961). This organism does not produce 3-ketolactose. Therefore this organism is a variant strain of *Agrobacterium radiobacter*.

TABLE 3

Biochemical and Other Miscellaneous Tests Employed for the Strain S-119

| | | | |
|---|---|---|---|
| Oxidase - Kovac's | + | Hydrolysis of: | |
| Pathotech | + | Gelatin | – |
| Catalase | + | Casein | – |
| OF medium: oxidative | + | Starch | – |
| fermentative | – | Tween 80 | – |
| Gas from glucose | – | Pectin | – |
| $H_2S$ production: T & I | – | Alginate | – |
| Cystine | + | Cellulose | – |
| Ammonium from peptone | NT | Chitin | – |
| β-Galactosidase | ± | DNA | NT |
| Arginine dihydrolase | – | Esculin | – |
| Lysine decarboxylase | – | Growth on various media: | |
| Ornithine decarboxylase | – | EMB agar | + |
| Tryptophan deaminase | NT | MacConkey agar | + |
| Phenylalanine deaminase | NT | SS agar | + |
| Urease | – | Mannitol salt agar | – |
| Indole | – | TCBS agar | – |
| MR test | – | Tinsdale tellurite blood agar | – |
| VP test | – | | |
| Nitrate reduction | – | Pseudosel agar | – |
| Nitrate reduction | – | Pigment production: | |
| Denitritication | NT | King A medium | – |
| N -fixation: | | King B medium | – |
| Growth on Burk's medium | – | Dye Reaction: | |
| Nitrogenase activity | NT | Congo Red | + |
| Malonate (oxidation) | – | Nile Blue | NT |
| Phosphatase | – | | |
| Haemolysis | – | | |
| Litmus milk: | | | |
| Change in color | None | | |
| peptonization | None | | |
| reduction | None | | |
| 3-Ketolactose | – | | |
| Survival at 60° C. for 30 min. | + | | |
| T & I: Slant | No change | | |
| Butt | No growth | | |
| Gas | – | | |
| Egg Yolk Reaction | – | | |

NT = Not Tested

FERMENTATION CONDITIONS

Heteropolysaccharide S-119 is produced during the aerobic fermentation of suitable aqueous nutrient media under controlled conditions via the inoculation with the organism ATCC 31643. The media are usual media, containing source of carbon, nitrogen and inorganic salts.

In general, carbohydrates (for example, glucose, fructose, maltose, sucrose, xylose, mannitol and the like) can be used either alone or in combination as sources of assimilable carbon in the nutrient medium. The exact quantity of the carbohydrate source or sources utilized in the medium depend in part upon the other ingredients of the medium but, in general, the amount of carbohydrate usually varies between about 2% and 5% by weight of the medium. These carbon sources can be used individually, or several such carbon sources may be combined in the medium. In general, many proteinaceous materials may be used as nitrogen sources in the fermentation process. Suitable nitrogen sources include, for example, yeast hydrosylates, primary yeast, soybean meal, cottonseed flour, hydrolysates of casein, cornsteep liquor, distiller's solubles or tomato paste and the like. The sources of nitrogen, either alone or in combination, are used in amounts preferably ranging from about 0.05% to 0.2% by weight of the aqueous medium. Promosoy 100 has been used in the range 0.005 to 0.4%.

Among the nutrient inorganic salts which can be incorporated in the culture media are the customary salts capable of yielding sodium, potassium, ammonium, calcium, phosphate, sulfate, chloride, carbonate, and like ions. Also included are trace metals such as cobalt, manganese, iron and magnesium.

It should be noted that the media described in the examples are merely illustrative of the wide variety of media which may be employed, and are not intended to be limiting.

As an alternate medium, S-119 is be grown under low $Ca^{++}$ conditions, i.e., in deionized water or some other aqueous system substantially free of $Ca^{++}$ ions (i.e., less than about 4 ppm $Ca^{++}$ per 1% gum in the final fermentor broth).

The fermentation is carried out at temperatures ranging from about 25° C. to 35° C.; however, for optimum results it is preferable to conduct the fermentation at temperatures of from about 28° C. to 32° C. The pH of the nutrient media for growing the ATCC 31643 culture and producing the polysaccharide S-119 can vary from about 6 to 8.

Although the polysaccharide S-119 is produced by both surface and submerged culture, it is preferred to carry out the fermentation in the submerged state.

A small scale fermentation is conveniently carried out by inoculating a suitable nutrient medium with the culture and, after transfer to a production medium, permitting the fermentation to proceed at a constant temperature of about 30° C. on a shaker for several days.

The fermentation is initiated in a sterilized flask of medium via one or more stages of seed development. The nutrient medium for the seed stage may be any suitable combination of carbon and nitrogen sources. The seed flask is shaken in a constant temperature chamber to about 30° C. for 1–2 days, or until growth is satisfactory, and some of the resulting growth is used to inoculate either a second stage seed or the production medium. Intermediate stage seed flasks, when used, are developed in essentially the same manner; that is, part of the contents of the flask from the last seed stage are used to inoculate the production medium. The inoculated flasks are shaken at a constant temperature for several days, and at the end of the incubation period the contents of the flasks are recovered by precipitation with a suitable alcohol such as isopropanol, conveniently in the form of CBM (an 85:15 alcohol:water constant boiling mixture).

For large scale work, it is preferable to conduct the fermentation in suitable tanks provided with an agitator and a means of aerating the fermentation medium. According to this method, the nutrient medium is made up in the tank and sterilized by heating at temperatures of up to about 121° C. Upon cooling, the sterilized medium is inoculated with a previously grown seed of the producing culture, and the fermentation is permitted to proceed for a period of time as, for example, from 2 to 4 days while agitating and/or aerating the nutrient medium and maintaining the temperature at about 30° C. This method of producing the S-119 is particularly suited for the preparation of large quantities.

Although ATCC 31643 can be grown under a broad spectrum of media conditions, the following preferred conditions are recommended.

1. Culture Maintenance

The culture grows quite well on nutrient agar (NA) or YM agar, but NA is preferred for culture maintenance.

2. Seed Preparation

Seed preparation for this organism is started in YM broth incubated at 30° C. The YM seeds are then used at 24–30 hrs to inoculate seed medium. The composition of the seed medium is as follows:

| | |
|---|---|
| 3.0% | Glucose |
| 0.5% | $K_2HPO_4$ |
| 0.05% | Promosoy 100 |
| 0.09% | $NH_4NO_3$ |
| 0.01% | $MgSO_4.7H_2O$ |
| 1 ppm | $Fe^{++}$ |
| 1 ppm | $Mn^{++}$ |

A 5 to 10% inoculum size is used at 24–30 hrs to inoculate the final fermentor.

3. 70L Fermentor Medium

| | |
|---|---|
| 5.0% | Glucose |
| 0.05% | $K_2HPO_4$ |
| 0.20% | Promosoy 100 |
| 0.15% | $NH_4NO_3$ |
| 0.05% | $MgSO_4.7H_2O$ |
| 1 ppm | $Fe^{++}$ |
| 1 ppm | $Mn^{++}$ |

The pH should be controlled at 6.5–7.2; the temperature at 30° C.

Fermentation times range from 60–70 hrs with beer viscosity ranging from 1900 cP to 2300 cP. Conversion efficiencies vary from 48–52% with 5% glucose. Antifoam SAG 471 (Union Carbide) is used.

Gram stains made from S-119 fermentation beer show gram-negative club-shaped cells approximately $0.6 \times 2.02.5\mu$ in size.

4. Recovery

On completion of the fermentation, the heteropolysaccharide S-119 may be recovered by treatment of the fermentation beer with a miscible solvent which is a poor solvent for the heteropolysaccharide and does not react with it. In this way the heteropolysaccharide is precipitated from solution. The quantity of solvent employed generally ranges from about 2 to about 3 volumes per volume of fermentation beer. Among the various solvents which may be employed are actone and lower alkanols such as methanol, ethanol, isopropanol, n-butanol, sec-butanol, tertiary butanol, isobutanol, and n-amyl alcohol. Isopropanol is preferred. Precipitation of S-119 is facilitated when the fermentation beer is first heated to a temperature of about 70° to 75° C. for a short time, e.g., about 5 to 10 minutes, and then cooled to about 30° C. or lower before addition of the solvent. A spent alcohol concentration of 57–59% is required for precipitation. Thus, this is a preferred method of precipitating the heteropolysaccharide from the fermentation beer. The solid is recovered by separating it from the liquid, as by filtering or straining, and then drying at elevated temperature.

5. Drying

The product is dried at 55° C. for up to one hour in a forced-air tray drier.

6. Product Quality

One percent deionized water viscosities range fro 250–450 cP as a measured on a Brookfield LVF, spindle 2, 60 rpm at 25° C.

HETEROPOLYSACCHARIDE S-119

The heteropolysaccharide produced by ATCC 31643 is composed of principally carbohydrate, 2.9–3.5% (calculated as O-acetyl) O-acyl groups as the O-glycosidically linked esters, which are acetyl or succinyl or a combination thereof, 3.0–4.0% pyruvate, and about 12% protein. It has a negative optical rotation, indicating principally $\beta$-linkages ($[\alpha]_{589}=-14°$; $[\alpha]_{578}=-15°$). These values were obtained from 1% solutions in D.I. water.

The carbohydrate portion of the S-119 polysaccharide contains no uronic acid and the neutral sugars glucose (88%) and galactose (12%). The approximate molar ratio of glucose to galactose is 7.4:1. Colloidal titration (DIMDAC/sulphonic acid method) indicates the gum is anionic (0.9 m. equivalents of anionic groups/g. gum).

The acetyl content of 3.5% was determined by treating a 0.2% aqueous solution of S-119 gum with an alkaline, hydroxylamine reagent followed by treatment with an acidic ferric chloride reagent [S. Hestrin (1949) *J. Biol. Chem.* 180 249–261].

The neutral sugars of polysaccharide S-119 were determined by dissolving ten mg. of the product in 2 ml 2 N $H_2SO_4$, and the mixture is heated at 100° C. for 4 hours. The resulting solution is cooled, neutralized with barium hydroxide and the pH is brought to 5–6 with solid carbon dioxide. The resulting precipitate of barium sulfate is removed by centrifugation and the supernatent is concentrated to a syrup under reduced pressure. The sugars in the hydrolysate are tentatively identified by gas-liquid chromatography of their aldononitrile acetone derivatives on a Hewlett-Packard Model 5750 chromatograph using 3% by weight OV-225 on 80/100 mesh Gas Chrom Q at 210° C. The sugars are identified and quantitated by comparison with authentic standards [J. K. Baird, M. J. Holroyde, and D. C. Ellwood (1973) Carbohydr. Res. 27 464–467].

The various neutral sugars of the polysaccharides were also characterized by use of descending paper chromatography on Whatman No. 1 chromatography paper using as the solvent the upper layer of pyridine:ethyl acetate:water (2:5:5). Chromatograms were stained using silver nitrate dip and acid aniline phthalate spray reagent. Component sugars were identified by co-chromatography with sugar standards and by the specific-color reaction with the analine phthalate reagent.

The uronic acid content of the polysaccharide was determined by two separate methods. In one method the sample was decarboxylated with 19% hydrochloric acid and the liberated carbon dioxide was trapped in standard sodium hydroxide and determined by back titration [B. L. Browning (1967) *Methods of Wood Chemistry II,* 632–633] and by the carbazole colorimetric method [T. Bitter and H. M. Muir (1962) *Anal. Biochem.* 4 330–334]. The decarboxylation method gave the value 2.8%; colorimetric gave 4.8%.

Paper electrophoresis was used for the separation and tentative identification of the uronic acids present in the neutralized acid hydrolysate described above. Aliquots of this and known uronic acid standards were applied to Camag electrophoresis paper No. 68-011 and electrophoresis was carried out for 2.0 hours in a pH 2.7 buffer using a Camag Model HVE electrophoresis apparatus. Chromatograms were air dried and stained with silver nitrate dip reagent to locate the uronic acids being separated. No uronic acid spots were found by this method.

An infrared spectrum of native S-119 was made on dried material in a KBr pellet. The heteropolysaccharide evidenced peaks at: 1725 $cm^{-1}$, 1600–1650 $cm^{-1}$, and 1350–1400 $cm^{-1}$.

Heteropolysaccharide S-119 has the following profile of properties (all measurements are at room temperature):

1. VISCOSITY (Brookfield LVT Viscometer)

| Conc. | Spindle | RPM | Viscosity (cP) D.I. $H_2O$ | Viscosity (cP) D.I. + 0.1% KCl |
|---|---|---|---|---|
| 1.0% | 3 | 60 | 920 | 1050 |
| — | 3 | 6 | 6900 | — |
| 0.1% | 1 + UL adap. | 6 | 35 | 30 |
| 0.5% | (Wells-Brookfield @ 9.6 $sec^{-1}$) | — | 440 | 490 |

2. SHEAR (Wells-Brookfield Microviscometer RVT - c/P)

| | | | |
|---|---|---|---|
| 1. n @ 1.92 $sec^{-1}$ | 5120 cP | 4. n @ 384 $sec^{-1}$ | 30 cP |
| 2. n @ 9.6 $sec^{-1}$ | 1270 cP | 5. n @ 384 $sec^{-1}$ | 40 cP |
| 3. n @ 76.8 $sec^{-1}$ | 210 cP | 6. n @ 9.6 $sec^{-1}$ | 1240 cP |

3. 50° C. STORAGE STABILITY (4 Weeks)

Day 1: 447.5 cP, Brookfield LVT, spin. #2, 60 rpm.
Wk. 4: 540 cP, Brookfield LVT, spin. #3, 60 rpm.

4. ACID, BASE, HEAT, STABILITY

A. Stability

| | Initial n | Final n | % Change |
|---|---|---|---|
| 1. Acetic acid plus heat | 1170 cP | 970 cP | −17 |
| 2. 1% HCl plus heat | 1330 cP | Total loss | Total loss |
| 3. 1% NaOH plus heat | 970 cP | 270 cP | −72 |
| 4. Heat only | 1230 cP | 500 cP | −59 |

B. pH Effect (Wells-Brookfield RVT - c/P @ 9.6 $sec^{-1}$)

| | | |
|---|---|---|
| 1. 5% Acetic acid | 2.98 pH | 1050 cP |
| 2. 5% $NH_4OH$ | 10.83 pH | 1370 cP |

5. SALT & DYE COMPATIBILITY

A. Salt

| | | | |
|---|---|---|---|
| 1. $CaCl_2$ (Saturated) | Compatible | 5. 1% $CaCl_2 \cdot 2H_2O$ | Compatible |
| 2. Amm. polyphosphate | Precipitate | 6. 1% KCl | Compatible |
| 3. 60% $NH_4NO_3$ | Compatible | 7. 0.1% KCl | 1570 cP* |
| 4. 1% $Al_2(SO_4)_3$. | Compatible | 8. 2.5% KCl | 1580 cP |

-continued $18H_2O$

B. Dyes

1. Milling Green Compatible 2. Methylene Blue Precipitate

6. TEXTURE/FLOW PROPERTIES

High viscosity gum, smooth continuous flow, elastic, no gelation, slightly gummy to the touch.

7. SYNERGISM & ENZYMES (Wells-Brookfield RVT - c/P at 9.6 $sec^{-1}$)

| | 1% n | 0 hour n of mixture | 2 hour n of mixture | Expected viscosity | Synergism |
|---|---|---|---|---|---|
| A. Guar | 1290 cP | 850 cP | 1340 cP | 1250 cP | +7% |
| B. H.P. Guar | 1820 cP | 1410 cP | 1430 cP | 1500 cP | None % |
| C. CMC | 790 cP | 450 cP | 490 cP | 980 cP | None % |
| D. HEC | 590 cP | 870 cP | 910 cP | 850 cP | +7% |
| E. S-119 | 1230 cP | | | | |

8. MILK REACTIVITY

A. Dispersion: Excellent

B. Whey off: 1st day

9. FILM FORMATION

Film formed, slightly plastic, high tensile strength.

*(Wells-Brookfield RVT - c/P @ 9.6 $sec^{-1}$)

The invention is further defined by reference to the following examples, which are intended to be illustrative and not limiting.

In the examples, reference is made to the following tests, all of which are recognized in the paper industry. Parenthetical references are to standards of the Technical Association of the Pulp and Paper Industry, Inc., 1 Dunwoody Pk., Atlanta, Ga., 30338.

1. Gurley Densometer Test: The film-forming property of a coating is measured by comparing at the same pressure and temperature the time in seconds it takes for 100 cc of air to pass through a 6.4 $cm^2$ piece of coated paper versus a piece of uncoated paper (i.e., air resistance). Air resistance indirectly indicates degree of beating, absorbency (penetration of oil, water, etc.), apparent specific gravity, filtering efficiency, etc. (TAPPI 460 OS-75).

2. K & N ® Mottle Test: The ink holdout property of a coating, i.e, estimates of resistance of a sheet of paper or paperboard to the penetration of ink and varnish are obtained by this method. A drop K & N gray oil-based ink is allowed to remain on a sample of treated paper for 2 minutes and then is wiped off. Poor ink film leveling gives a mottled appearance to the paper, which is rated on a scale of 0 to 10 (poor to excellent). (TAPPI 553)

®K & N is a registered trademark of K & N Laboratories, Inc., 5331 Donsher Rd., Countryside, Ill., 60525.

3. Quick Peek Varnish Gloss Test: The varnish holdout of a coated surface is measured. A standard varnish of 1 micron thickness is applied by an inking roller to the paper surface. After the ink is dried, over 4 hours, the varnish gloss is measured by a Photo-volt Gloss Meter at a 70° reflection angle. (A little Joe Litho Proof Press was used to print samples 2 and 3 (Table 4) with a standard (Custom Ink) black high-gloss litho ink (Cal Ink., Oakland Ca.) and then these were tested for the percent ink gloss.) A paper surface of higher ink holdout would give a higher ink gloss reading.

4. Cotton Seed Oil Penetration Test: The time required (in seconds) for one drop (0.03 ml) of red-dyed cotton seed oil to be absorbed on the surface of a treated sample is measured by visually observing the time to penetration to the reverse side of the sample. This method is similar to the TAPPI T 454.

Viscosities are measured using two methods:

1. Brookfield Viscometer LVF, Spindles 2 and 3, at room temperature is used to measure viscosity in centipoise. The ratio 6/60 RPM is used as an indication of pseudoplasticity and leveling properties. A 6/60 RPM ratio of over 3.5 and a viscosity of about 500–1000 cP for a 1% solution would indicate a probable gelling or extreme shear-thinning property.

2. Hercules Hi-Shear Viscometer, high-shear viscosity at room temperature, E bob, 0–4400 rpm, 100,000 dyne/cm spring tension, 0–49,500 $sec^{-1}$, is used to measure viscosity in centipoise at 49,500 $sec^{-1}$ shear rate.

EXAMPLE 1

Pilot Plant Production of Heteropolysaccharide S-119

Seed preparation is started in YM broth incubated at 30° C. The YM seeds are used 24 hours to inoculate 100 gal. of seed medium which is composed of:

3.0% Glucose
0.5% $K_2HPO_4$
0.05% Promosoy 100
0.09% $NH_4NO_3$
0.01% $MgSO_4.7H_2O$
0.13% Defoamer FCA-200*
+ 1 ppm $Fe^{++}$
+ 1 ppm $Mn^{++}$

*Union Carbide

At 29 hours, 100 gal. of this medium is used to inoculate the final fermentor.

| | | |
|---|---|---|
| Inoculum: (100 gals) | Age - 29 hrs | |
| | pH - NA | |
| | Viscosity - 700 cP | |
| Medium: (1100 gals) | Glucose | 5.0% |
| | $NH_4NO_3$ | 0.15% |
| | $K_2HPO_4$ | 0.05% |
| | Promosoy 100 | 0.20% |
| | $MgSO_4.7H_2O$ | 0.05% |
| | FCA-200 | 0.08% |
| | KOH | To control pH at 6.5–7.2 |

Fermentation:
Time - 63 hrs
Beer pH - 7.6
Temperature - 30° C.
Aeration - 0 hrs: 40 CFM;
15 hrs: 80 CFM;
35 hrs: 100 CFM;
Viscosity - 1680 cP
Agitation: Disc and turbine impellors
Number of sets: 3
Number of blades/set: 5
Disc diameter: 20 inches
Blade dimension: 2½" × 4"
Impellor diameter: 28"
Speed 150 rpm
Recovery: Beer pH adjust to 6.9 with $H_2SO_4$
Beer rate - 5 gpm
Pasteurization - 165° F./6–7 min.
Ppt. with 60% spent IPA
Dried at 150° F., for ~30 min., max.
Milled through 40 mesh
Yield: 2.08%

EXAMPLE 2

Paper Finish

A paper finish using three samples of S-119 is prepared by dissolving S-119 in D. I. water at ambient temperature with agitation for one hour. For comparison a similar finish is prepared using a medium viscosity sodium alginate (KELGIN MV®, Kelco Div. of MERCK & CO., Inc., San Diego, Calif.). Draw-down rods Nos. 4 and 12 are used to coat the solutions onto a standard coating raw stock of 60 gms/m$^2$ basis weight. The data of Table 4 are obtained.

TABLE 4

PAPER FINISH

| Items | Solid (%) | Coat Wt. (g/m$^2$) | Densometer (sec.) | K & N | Quick Peek (sec.) | Cotton Seed (sec.) | Brookfield Visc. (cP) 6 RPM | Brookfield Visc. (cP) 60 RPM | Brookfield Visc. (cP) 6/60 RPM Ratio | Hercules Visc. (cP) |
|---|---|---|---|---|---|---|---|---|---|---|
| Paper | 0. | 0. | 11 | 1 | 10 | 0 | — | — | — | — |
| Sample 1 | 0.5 | 0.11 | 17 | 4 | 15 | 9 | 250 | 100 | 2.5 | — |
| | 0.5 | 0.17 | 23 | 4 | 17 | 10 | | | | |
| | 1.0 | 0.17 | 26 | 5 | 15 | 7 | 2200 | 430 | 5.1 | — |
| | 1.0 | 0.26 | 29 | 4 | 18 | 11 | | | | |
| | 2.0 | 0.32 | 31 | 6 | 20 | 10 | 5400 | 850 | 6.3 | — |
| | 2.0 | 0.50 | 83 | 6 | 19 | 33 | | | | |
| | 4.0 | 0.63 | 110 | 7 | 20 | 8 | 7500 | 2000 | 3.8 | — |
| | 4.0 | 1.00 | 414 | 8 | 23 | 35 | | | | |
| Sample 2 | 0.5 | 0.15 | 20 | 8 | 19* | 9 | 1375 | 205 | 6.7 | 3.2 |
| | 0.5 | 0.17 | 26 | 8 | 21 | 15 | | | | |
| | 1.0 | 0.39 | 32 | 8.5 | 23 | 13 | 2625 | 395 | 6.6 | 3.4 |
| | 1.0 | 0.37 | 58 | 8.5 | 27 | 20 | | | | |
| | 1.5 | 0.47 | 74 | 9 | 33 | 16 | 4200 | 610 | 6.9 | 5.0 |
| | 1.5 | 0.42 | 91 | 9 | 30 | 25 | | | | |
| Sample 3 | 0.5 | 0.11 | 15 | 7 | 18* | 8 | 725 | 150 | 4.6 | 2.9 |
| | 0.5 | 0.14 | 18 | 7 | 21 | 11 | | | | |
| | 1.0 | 0.24 | 21 | 8 | 21 | 16 | 2600 | 380 | 6.9 | 3.2 |
| | 1.0 | 0.44 | 9 | 8 | 28 | 15 | | | | |
| | 1.5 | 0.53 | 51 | 9 | 25 | 17 | 5400 | 710 | 7.6 | 3.8 |
| | 1.5 | 0.56 | 69 | 9 | 26 | 17 | | | | |
| KNMV | 0.5 | 0.08 | 36 | 7 | 19 | 12 | 75 | 65 | 1.2 | — |
| | 0.5 | 0.12 | 34 | 7 | 20 | — | | | | |
| | 1.0 | 0.16 | 96 | 7.5 | 20 | 50 | 400 | 340 | 1.2 | — |
| | 1.0 | 0.30 | 350 | 8 | 20 | — | | | | |
| | 2.0 | 0.38 | 1850 | 8 | 21 | — | 6000 | 3600 | 1.7 | — |
| | 2.0 | .54 | 3470 | 8 | 19 | — | | | | |

*Little Joe Litho Proof Press

What is claimed is:

1. An aqueous paper finish composition comprising:

| | Parts |
|---|---|
| Pigment | 100 |
| Binding agent | 5–50 |
| Brightening agent | 0–3 |
| Dispersing agent | 0–1 |
| Alkali | 0–1 |
| Heteropolysaccharide S-119 | 0.1–10 |

said heteropolysaccharide S-119 being anionic and composed of principally carbohydrate, 2.9–3.5%, calculated as O-acetyl, O-acyl groups as the O-glycosidically linked esters, which are acetyl or succinyl or a combination thereof, 3.0–4.0% pyruvate, about 12% protein, the carbohydrate portion of which contains no uronic acid and the neutral sugars glucose and galactose in the approximate molar ratio of glucose to galactose of 7.4:1, said sugars being primarily $\beta$-linked.

2. A composition of claim 1 comprising:

| | Parts |
|---|---|
| Pigment | 100 |
| Binding agent | 10–25 |
| Brightening agent | 0.1–1.0 |
| Dispersing agent | 0.1–0.4 |
| Alkali | 0.05–0.5 |
| Heteropolysaccharide S-119 | 0.1–2 |

3. A process for finishing paper which comprises coating the paper with an aqueous composition which comprises water and 0.001 to 10% (wt/wt) of heteropolysaccharide S-119, which is anionic and composed of principally carbohydrate, 2.9–3.5%, calculated as O-acetyl, O-acyl groups as the O-glycosidically linked esters, which are acetyl or succinyl or a combination thereof, 3.0–4.0% pyruvate, about 12% protein, the carbohydrate portion of which contains no uronic acid and the neutral sugars glucose and galactose in the approximate molar ratio of glucose to galactose of 7.4:1, said sugars being primarily $\beta$-linked.

4. A process of claim 3 wherein the composition comprises 0.5 to 2% of heteropolysaccharide S-119.

5. A process of claim 4 wherein the composition comprises:

| | Parts |
|---|---|
| Pigment | 100 |
| Binding agent | 5–50 |
| Brightening agent | 0–3 |
| Dispersing agent | 0–1 |
| Alkali | 0–1 |
| Heteropolysaccharide S-119 | 0.1–10 |

6. A process of claim 4 wherein the composition comprises:

| | Parts |
|---|---|
| Pigment | 100 |
| Binding agent | 10–25 |
| Brightening agent | 0.1–1.0 |
| Dispersing agent | 0.1–0.4 |
| Alkali | 0.05–0.5 |
| Heteropolysaccharide S-119 | 0.1–2 |

* * * * *